United States Patent [19]

Hyink

[11] Patent Number: 4,675,023

[45] Date of Patent: Jun. 23, 1987

[54] METHOD OF PRODUCING A MOSAIC EXPRESSION ON FABRIC

[76] Inventor: Barbara Hyink, 30802 S. Coast Hwy., D-15, Laguna Beach, Calif. 92651

[21] Appl. No.: 744,257

[22] Filed: Jun. 13, 1985

[51] Int. Cl.[4] ..... D06P 5/12; D06Q 1/00

[52] U.S. Cl. ..... 8/447; 8/478; 8/482; 8/485; 427/155

[58] Field of Search ..... 8/482, 485, 478, 447; 428/906.6

[56] References Cited

PUBLICATIONS

Samuel, Evelyn, *Introducing Batik,* B T Batsford Limited, London.

Krevitsky, N. K., *Batik Art and Craft,* Reinhold Publishing Corp., New York.

Belfer, Nancy, Designing in Batik and Tie Dye, 1972, pp. 32–34, Davis Publication.

O'Brien, James F., Design by Accident, 1968, p. 138, Dover Publications.

Holiday, Ensor, Altair Design 3, pp. 1–8, Pantheon Books.

*Primary Examiner*—Paul Lieberman

*Assistant Examiner*—Linda Skaling

*Attorney, Agent, or Firm*—Willie Krawitz

[57] ABSTRACT

A new and unique method of producing a mosaic-like work of art on a sheet of fabric material. Once the fabric and its basic color is selected, a coating of melted wax is applied to one surface thereof. After the wax is dry, the fabric is crackled so as to form random and skewed cracks. Dye is then applied which penetrates the cracks and is absorbed by the fabric, whereby random skewed lines are left in the fabric after the wax is removed. The random skewed lines define a multiplicity of contiguous areas to be selectively painted so as to render a mosaic-like work of art.

3 Claims, 2 Drawing Figures

METHOD OF PRODUCING A MOSAIC EXPRESSION ON FABRIC

BACKGROUND OF THE INVENTION

This invention relates to a method of producing an artistic mosaic expression on fabric.

In the world of art, various methods are employed to produce unique works. Most known art mediums and forms have been employed for many years and are well known in art circles. There has not been much room for improvement in artistic processes for establishing new unique art forms.

One known art form is that of providing pictures or designs through the medium of mosaics, i.e., by inlaying small pieces of colored stone, glass, tile, etc., in mortar.

Another art form is that of painting pictures and/or designs through the medium of oils, water colors, etc.

An art form known as "batik" comprises a method of dyeing designs in cloth by first coating the cloth with removable wax over the parts not to be dyed, and then selectively impregnating various designs and decorations within the fabric structure.

SUMMARY AND OBJECTS OF THE INVENTION

As will hereinafter be described in detail, the present invention includes a method of combining the above medias in such a novel fashion that one may produce a fabric having a unique artistic end result defining a mosaic work of art not known heretofore.

Thus, an important object of the present invention is to establish and provide a new and unique art form by combining the method of batik with mosaic-like paintings, whereby various and unlimited artistic expressions can be generated.

The characteristics and advantages of the present invention are further sufficiently referred to in connection with the accompanying drawings, which represent one or more embodiments. After considering the various disclosed examples of the invention, skilled persons will understand that many variations may be made without departing from the principles as disclosed herein; and I contemplate the employment of any structures, arrangements or modes of steps in the operation of the process that are properly within the scope of the appended claims.

BRIEF DESCRIPTION OF THE DRAWINGS

Referring more particularly to the accompanying drawings, which are for illustrative purposes only.

DETAILED DESCRIPTION OF THE INVENTION

Figure 1:
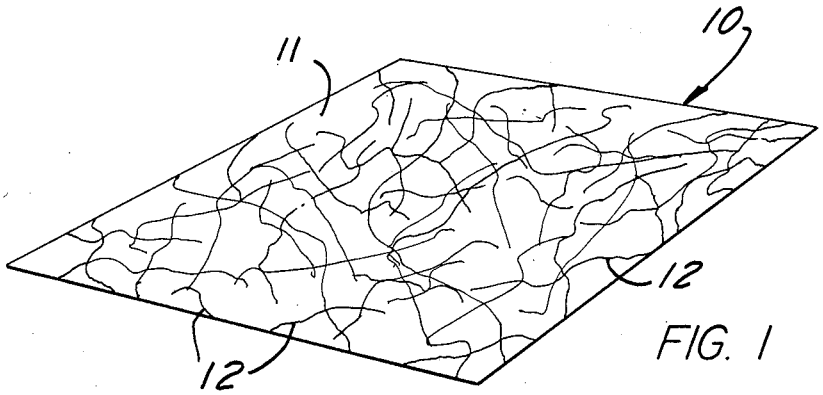
FIG. 1 is a perspective view of a sheet of fabric after the method of batik has been employed.

Referring more particularly to FIG. 1, there is shown a workpiece, generally indicated at 10, formed from a suitable fabric material 11. The most suitable fabric would be cotton. However, silk or a combination of soft absorbent material that retain dyes can also be employed.

Accordingly, the first step of the present process is to provide a sheet of suitable fabric material 11 of a selective overall size and configuration. The fabric can be first dyed in a selective color or colors; or, if a white background is preferred, dyeing is not necessary. Thus, one would select the basic color of the fabric prior to batiking.

The next step is batiking of the fabric. The process can be done in two different or combined steps. Selective areas of the fabric may be covered with melted wax, whereupon the wax is allowed to dry and then the fabric is given a light color wash or the exposed fabric areas are dyed. If so desired, there may be several selective wax applications followed by several different applications of selective colors of dyes.

Figure 2:
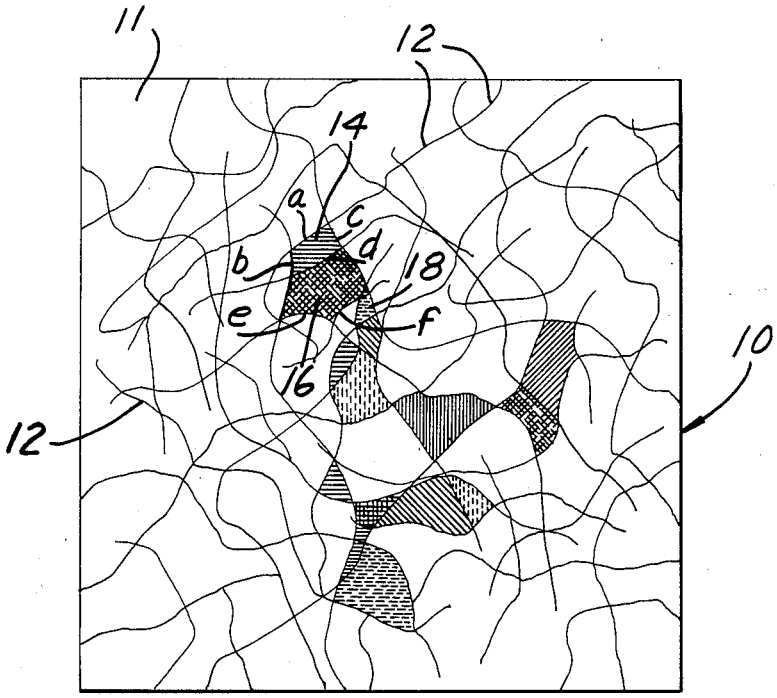
FIG. 2 is an elevational view of a finished art work using the combined methods of batik, painting, and mosaically arranging the selective defined areas of the piece.

After the step of dyeing has been completed, the entire surface of the fabric is covered with melted wax in the typical batik manner. The wax is allowed to dry and is then crackled to provide a multiplicity of random and skewed patterns over the entire surface or a selective portion of the fabric surface. In order to establish the random skewed lines 12 as illustrated in both FIGS. 1 and 2, a colored liquid (ink or dye) is applied in a suitable manner such as brushing the liquid over the cracked surface so as to allow the colored liquid to penetrate through the cracks into the exposed fabric.

Once the last step is completed, the wax is removed from the fabric. This can be done in more than one way, but generally the wax is removed by placing one or more layers of absorbent material (paper) over the wax surface and applying heat, whereby the melted wax is absorbed into the material. However, it should be noted that not all the wax is completely removed, and normally the fabric is left in a flexible but stiffened condition. If a softer fabric condition is desired, the excess wax may be removed by placing the fabric in boiling water.

When the fabric is dry, the final remaining steps are then taken. The artist selectively choose various contiguous areas outlined by the random skewed lines 12 to create the desired artistic mosaic design. As an example, in FIG. 2 lines marked a, b, c and d define a selected area 14; while lines b, c and d, together with lines 3 and f, define a second or contiguous area 16. Thus, several contiguous areas will define a mosaic rendition, with each area being selectively painted within its defined linear borders. The lines within area 14 can indicate the color blue; the lines within area 16 indicate the color orange; and the lines within area 18 indicate the color silver; and so on.

Therefore, it can be seen that, by properly selecting defined areas, one can create numerous works of art. One's artistic imagination can perceive unlimited renditions.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A new and unique process of forming a mosaic-like work of art consisting of the steps of:

providing a fabric material that is capable of being dyed, or inked; coloring said fabric to form a batik;

applying a melted-wax coating over the surface of said fabric; allowing said melted wax to dry to a hardened state;

crackling said hardened wax over selected portions of the said fabric, whereby skewed cracks are formed in the waxed surface;

painting an ink over selected cracks in the wax, whereby said ink penetrates through said cracks and is absorbed in said fabric, thereby defining skewed lines thereon without bleeding into the fabric;

removing said wax from said fabric by melting the wax with heat and absorbing the melted wax with an absorbent material, sufficient wax being retained to leave the fabric in a flexible, but stiffened condition, and permit inking a mosaic thereon without bleeding into the fabric;

selecting a multiplicity of various areas outlined by said skewed lines so as to create the desired artistic design of said work of art; and, painting said selected areas in ink to form a mosaic overlaying the said coloring so as to complete the rendition of said work of art.

2. A new and unique process as recited in claim 1, wherein at least three or more random skewed lines define each contiguous area to be selectively painted.

3. A mosaic-like work of art, comprising:

a. a fabric material adapted for dyeing or inking, the fabric having imprinted thereon a batik pattern; and, b. a mosaic pattern superimposed over the batik pattern, the mosaic pattern being form by the steps, comprising:

i. applying a melted-wax coating over the surface of said fabric;

ii. allowing said melted wax to dry to a hardened state;

iii. crackling said hardened wax over selected portions of the said fabric, whereby skewed cracks are formed in the waxed surface;

iv. painting an ink over selected cracks in the wax, whereby said ink penetrates through said cracks and is absorbed in said fabric, thereby defining skewed lines thereon without bleeding into the fabric;

v. removing said wax from said fabric by melting the wax with heat and absorbing the melted wax with an absorbent material, sufficient wax being retained to leave the fabric in a flexible, but stiffened condition, and permit inking a mosaic thereon without bleeding into the fabric;

vi. selecting a multiplicity of various areas outlined by said skewed lines so as to create the desired artistic design of said work of art; and, vii. painting said selected areas in ink to form a mosaic overlaying the said coloring so as to complete the rendition of said work of art.

* * * * *